US010662690B2

(12) United States Patent
Schluge

(10) Patent No.: US 10,662,690 B2
(45) Date of Patent: May 26, 2020

(54) ACTUATING ARM DRIVE

(71) Applicant: Julius Blum GmbH, Hoechst (AT)

(72) Inventor: Philip Schluge, Dornbirn (AT)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 16/112,019

(22) Filed: Aug. 24, 2018

(65) Prior Publication Data

US 2018/0363348 A1 Dec. 20, 2018

Related U.S. Application Data

(63) Continuation of application No. PCT/AT2017/060043, filed on Feb. 23, 2017.

(30) Foreign Application Priority Data

Feb. 26, 2016 (AT) ..... A 50146/2016

(51) Int. Cl.
*E05F 1/08* (2006.01)
*E05F 1/12* (2006.01)
(Continued)

(52) U.S. Cl.
CPC ..... *E05F 1/1253* (2013.01); *E05D 15/401* (2013.01); *E05F 1/1058* (2013.01);
(Continued)

(58) Field of Classification Search
CPC ..... E05F 1/1276; E05F 1/1246; E05F 1/1253; E05F 1/1261; E05F 1/1058; E05F 1/1075;
(Continued)

(56) References Cited

U.S. PATENT DOCUMENTS 7,178,202 B2 * 2/2007 Hirtsiefer ..... E05D 3/14 16/286
7,240,974 B2 * 7/2007 Hirtsiefer ..... E05D 15/262 312/109
(Continued)

FOREIGN PATENT DOCUMENTS

CN 101111655 1/2008
DE 10203269 8/2003
(Continued)

OTHER PUBLICATIONS

International Search Report dated May 29, 2017 in International (PCT) Application No. PCT/AT2017/060043.
(Continued)

*Primary Examiner* — Chuck Y Mah
(74) *Attorney, Agent, or Firm* — Wenderoth, Lind & Ponack, L.L.P.

(57) ABSTRACT

An actuating arm drive for a pivotably mounted actuating arm includes a pivotably mounted main lever, a force accumulator for exerting a force for supporting the opening and/or closing movement of the actuating arm drive on the main lever at a force introduction point, and a setting device for setting the force introduction point on the main lever. The force is introduced to the main lever at the force introduction point via a force introduction element which is loaded by the force accumulator via levers, and the setting device is designed to move the force introduction element along a bearing contour formed on the main lever. In each pivoting position of the main lever between the open and closed position of the actuating arm drive, and in each setting of the setting device, the loaded force introduction element is forced along the bearing contour in the same direction.

20 Claims, 16 Drawing Sheets

(51) Int. Cl.
*E05F 1/10* (2006.01)
*E05D 15/40* (2006.01)
*E05F 1/14* (2006.01)

(52) U.S. Cl.
CPC ..... *E05F 1/14* (2013.01); *E05Y 2201/618* (2013.01); *E05Y 2900/20* (2013.01)

(58) Field of Classification Search
CPC ..... E05F 1/14; E05F 3/20; E05D 3/16; E05D 11/00; E05Y 2201/21; E05Y 2201/264; E05Y 2201/47; E05Y 2201/492; E05Y 2201/618; E05Y 2900/20; E05Y 2900/202; A47B 2220/0072; Y10T 16/5383; Y10T 16/547; Y10T 16/5476
See application file for complete search history.

(56) References Cited

U.S. PATENT DOCUMENTS 7,500,287 B2 * 3/2009 Brustle ..... E05F 1/1075 16/286
7,810,213 B2 * 10/2010 Brustle ..... E05F 1/1075 16/286
7,987,558 B2 8/2011 Beckmann et al.
8,321,996 B2 * 12/2012 Hirtsiefer ..... E05D 3/14 16/286
8,807,670 B2 * 8/2014 Blum ..... E05F 1/1276 312/319.2
8,959,709 B2 * 2/2015 Hasegawa ..... E05D 3/14 16/65
9,145,722 B2 9/2015 Gherardi
9,464,473 B2 10/2016 Baldreich
9,506,283 B2 11/2016 Folie
9,719,283 B2 8/2017 Holzapfel
10,407,962 B2 9/2019 Schluge
2001/0039762 A1 11/2001 Giovannetti
2010/0162847 A1 * 7/2010 Gassner ..... E05F 1/1058 74/490.07
2014/0317883 A1 10/2014 Baldreich
2014/0319987 A1 * 10/2014 Blum ..... E05F 1/1276 312/319.2
2015/0361705 A1 12/2015 Folie
2016/0333620 A1 11/2016 Holzapfel
2017/0044812 A1 2/2017 Schluge
2018/0291665 A1 * 10/2018 Guzeltepe ..... E05D 15/401

FOREIGN PATENT DOCUMENTS

DE 20 2010 000 096 4/2011
DE 202010015092 2/2012
EP 1 154 109 11/2001
JP 2015-508851 3/2015
WO 2013/113047 8/2013
WO 2013/171261 11/2013
WO 2015/135005 9/2015
WO 2015/164894 11/2015

OTHER PUBLICATIONS

Search Report dated Nov. 25, 2016 in Austrian Application No. A 50146/2016, with English translation.
Search Report dated Aug. 26, 2019 in Chinese Patent Application No. 201780019947.9, with English-language translation.

* cited by examiner

ACTUATING ARM DRIVE

BACKGROUND OF THE INVENTION

The present invention relates to an actuating arm drive for at least one pivotably mounted actuating arm, as well as a piece of furniture with at least one such actuating arm drive.

A number of actuating arm drives for supporting the opening and closing movement of furniture flaps of pieces of furniture are known in the state of the art. Usually, the force exerted on the furniture flap by the actuating arm drive can be set. Such a settability can be constituted, for example, by setting the point of application of the force originating from an energy storage mechanism of an actuating arm drive on a driven lever of an actuating arm.

Disadvantages of conventional actuating arm drives known in the state of the art are the force to be applied by a user to set the transmission of force, the small adjustment range of the setting, the indirect relationship between the chosen setting and the force resulting therefrom as well as the undesired development of noise due to unfavorable loading of the parts of the actuating arm drive which are associated with the setting when the actuating arm is pivoted.

SUMMARY OF THE INVENTION

The object of the invention is to specify an actuating arm drive that is improved compared with the state of the art.

This object is achieved by an actuating arm drive as described below, as well as by a piece of furniture with such an actuating arm drive.

The object is achieved according to the invention in that the force is transmitted to the main lever at the force-transmission point via a force-transmission element loaded by the energy storage mechanism—preferably via levers—and the setting device is formed to adjust the force-transmission element along a bearing contour formed on the main lever. By 'main lever' is meant a lever of the actuating arm on which the force originating from the energy storage mechanism acts. By 'force-transmission point' is meant the point or the line or area in which or on which the force is transmitted to the main lever. By 'force-transmission element' is meant, in turn, a component or a group of components which bears on the main lever and transmits the force originating from the energy storage mechanism to it. For the bearing, the main lever has a bearing contour formed on it. The setting device is formed to adjust the force-transmission element along the bearing contour for setting the force-transmission point on the main lever. The spacing of the force-transmission point from the pivot axis of the pivotably mounted main lever can be changed by adjusting the force-transmission element along the bearing contour, whereby the driving force of the actuating arm drive can be set. A direct transmission of force and simple settability of the force-transmission point can be achieved by transmitting the force to the main lever through a force-transmission element which bears on a bearing contour formed on the main lever.

It can be advantageous here that the loaded force-transmission element is pushed along the bearing contour in the same direction in every pivot position of the main lever between the open position and the closed position of the actuating arm drive and in every setting of the setting device. By 'pivot position of the actuating arm drive' is meant the position of the actuating arm or of the main lever of the actuating arm. By 'setting of the setting device' is meant the position of the force-transmission element along the bearing contour formed on the main lever. Because the force-transmission element is pushed along the bearing contour in the same direction in every pivot position of the main lever, an opening and/or closing movement of the actuating arm drive free of load reversal can be achieved. The component of the force originating from the energy storage mechanism with which the force-transmission element is loaded in the direction of the bearing contour (tangential force) is thus aligned or oriented identically in every pivot position of the main lever between the open position and/or the closed position of the actuating arm drive.

It can also be advantageous that the bearing contour is curved. A curved formation of the bearing contour can result in a particularly preferred adjustability of the force-transmission element and an associated settability of the actuating arm drive. In particular, a curved formation of the bearing contour can result in a larger adjustment range of the setting device in conjunction with the property that the force-transmission element is pushed along the bearing contour in the same direction in every pivot position of the main lever and in every setting of the setting device. A curved formation of the bearing contour can also result in a particularly direct relationship between the setting of the setting device (position of the force-transmission element along the bearing contour) and the setting of the actuating arm drive (force acting on a flap).

It can be advantageous here that the curvature of the bearing contour is constant. A bearing contour with a constant curvature can be produced simply in terms of process engineering and can make a particularly favourable relationship between the setting of the setting device and the setting of the actuating arm drive possible.

It can also be advantageous here that the bearing contour is concavely curved. With a concave curvature of the bearing contour, inclined towards the force-transmission element, a large adjustment range of the setting device can be made possible, together with the property that the force-transmission element is always pushed along the bearing contour in the same direction.

In a pivot position of the main lever corresponding to the open position of the actuating arm drive, in every setting of the setting device, the line of action of the force acting on the main lever from the energy storage mechanism forms an acute angle with the bearing contour. An open position of the actuating arm drive can correspond to a pivot position of the main lever in which a flap of a piece of furniture driven by the actuating arm drive is in an opened position. Because the line of action along which the force originating from the energy storage mechanism acts on the main lever forms an acute angle with the bearing contour in every setting of the setting device—thus at every point of the force-transmission element along the bearing contour—a preferred settability of the setting device and an extended adjustment range can be achieved. In particular, an application of force by the force-transmission element oriented identically over the whole adjustment range of the setting device can be achieved. A load reversal can thereby be avoided in particular in the open position of the actuating arm drive and a setting of the setting device that is free of load reversal can be made possible.

It is also advantageous for the main lever to have a profiled cross section and the bearing contour to be formed at end faces of the profile. An advantageously stable design of the actuating arm drive can be achieved by a formation of the main lever that is profiled in cross section, for example having a U-shaped profile. Due to the formation of the bearing contour at the end faces of the profile, the actuating arm drive can be produced simply in terms of process engineering. The force acting on the main lever can also thereby be distributed over several points or over a larger surface area.

It can further be advantageous if the force-transmission element, at least in sections, has a contour which deviates from the cylindrical surface and preferably corresponds in its curvature to the curvature of the bearing contour. A contour deviating from the cylindrical surface makes it possible for the force-transmission point of the force-transmission element to be a line or surface bearing on the bearing contour. If the curvature of the force-transmission element corresponds to the curvature of the bearing contour, a particularly preferred form of the bearing between the force-transmission element and the bearing contour can result.

It can be advantageous for the force-transmission element to be formed as a profiled transverse pin and/or as a roller and/or as a slide. By 'transverse pin' is meant a pin or substantially rod-shaped component running substantially transversely to the line of action of the force originating from the energy storage mechanism. By 'slide' is meant a displaceable component that bears flat. The profiling of the transverse pin can likewise be designed such that a flat bearing results on the bearing contour.

It can further be advantageous that the setting device is self-locking. It can thereby be made possible for a setting made on the setting device to persist during operation of the actuating arm drive without further securing means.

It can further be advantageous if the setting device has a transfer device which converts a setting movement of the setting device into a translational movement of the force-transmission element. By means of the transfer device, the position of the force-transmission element can be adjusted along the bearing contour by a setting movement of the setting device. The transfer device can, for example, convert a rotational movement into a translational movement.

It can be advantageous here that the transfer device is formed by a threaded spindle rotatably mounted on the main lever with a sliding block, which is connected to the force-transmission element, engaging in the threaded spindle. By actuating the threaded spindle that is mounted rotatably on the main lever, the force-transmission element can thus be adjusted together with the sliding block.

It can further be advantageous if the sliding block is mounted displaceably in a guideway—preferably running substantially in a straight line—formed in the main lever, and is connected in an articulated manner to the force-transmission element via a connecting piece. Here, the sliding block can be mounted in a rotatably fixed manner and displaceable in a guideway formed in the main lever and be connected in an articulated manner to the force-transmission element via a connecting piece. The connecting piece can be capable of transmitting tensile or compressive stresses. During actuation of the rotatably mounted threaded spindle, the sliding block can thus be adjusted together with the force-transmission element along the guideway formed in the main lever. The force-transmission element and/or the sliding block can in each case be mounted pivotably or rotatably on or in the connecting piece, whereby an articulated connection is formed between the force-transmission element and the sliding block.

It can further be advantageous if, in a pivot position of the main lever corresponding to the open position of the actuating arm drive, the force-transmission element is adjusted along the bearing contour substantially transversely to the line of action of the force acting on the main lever from the energy storage mechanism. Through an adjustment of the force-transmission element along the bearing contour effected substantially transversely to the line of action of the force acting from the energy storage mechanism, a particularly direct relationship between the setting of the setting device (position of the force-transmission element along the bearing contour) and the setting of the actuating arm drive (force on a driven furniture part) can be achieved.

It can further be advantageous that, in a position of the main lever corresponding to the closed position, the line of action of the force acting on the main lever from the energy storage mechanism runs in relation to the pivot axis of the main lever in such a way that the main lever is pushed into the closed position. It can thereby be achieved that a furniture part driven by the actuating arm drive can be held actively in a closed position and also actively in an open position. For example, in a position of the main lever corresponding to the closed position, the line of action of the force originating from the energy storage mechanism can run above the pivot axis of the main lever in the installed position of the actuating arm drive and thus push the main lever into the closed position under the action of force. When the main lever is pivoted out of the closed position, the line of action of the force acting on the main lever from the energy storage mechanism, for example in the installed position of the actuating arm drive, can run below the axis of rotation of the main lever (dead-center mechanism), and the opening movement of the actuating arm drive can be supported by the energy storage mechanism. When the open position is reached, the main lever can additionally be pushed actively into the open position.

It can further be advantageous that the energy storage mechanism has at least one spring—preferably installed lying down in the installed position of the housing. A design of the energy storage mechanism that is simple to produce and durable can be achieved by forming the energy storage mechanism with a spring, for example a compression spring. A compact and space-saving formation of the actuating arm drive can particularly preferably be achieved with a spring installed lying down in the installed position of the housing of the actuating arm drive, thus running substantially horizontally. Here, the force of the spring can be transmitted to the main lever or the force-transmission element via a bell crank and a transfer lever connected thereto in an articulated manner.

A piece of furniture can have at least one actuating arm drive as described above. The piece of furniture can have a furniture carcass in which the at least one actuating arm drive can be installed and at least one furniture flap, which can be driven by the at least one actuating arm drive.

BRIEF DESCRIPTION OF THE DRAWINGS

Further details and advantages of the present invention are explained in more detail below with the aid of the description of the figures with reference to the embodiment examples represented in the drawings. There are shown in.

DETAILED DESCRIPTION OF THE INVENTION

Figure 1A:
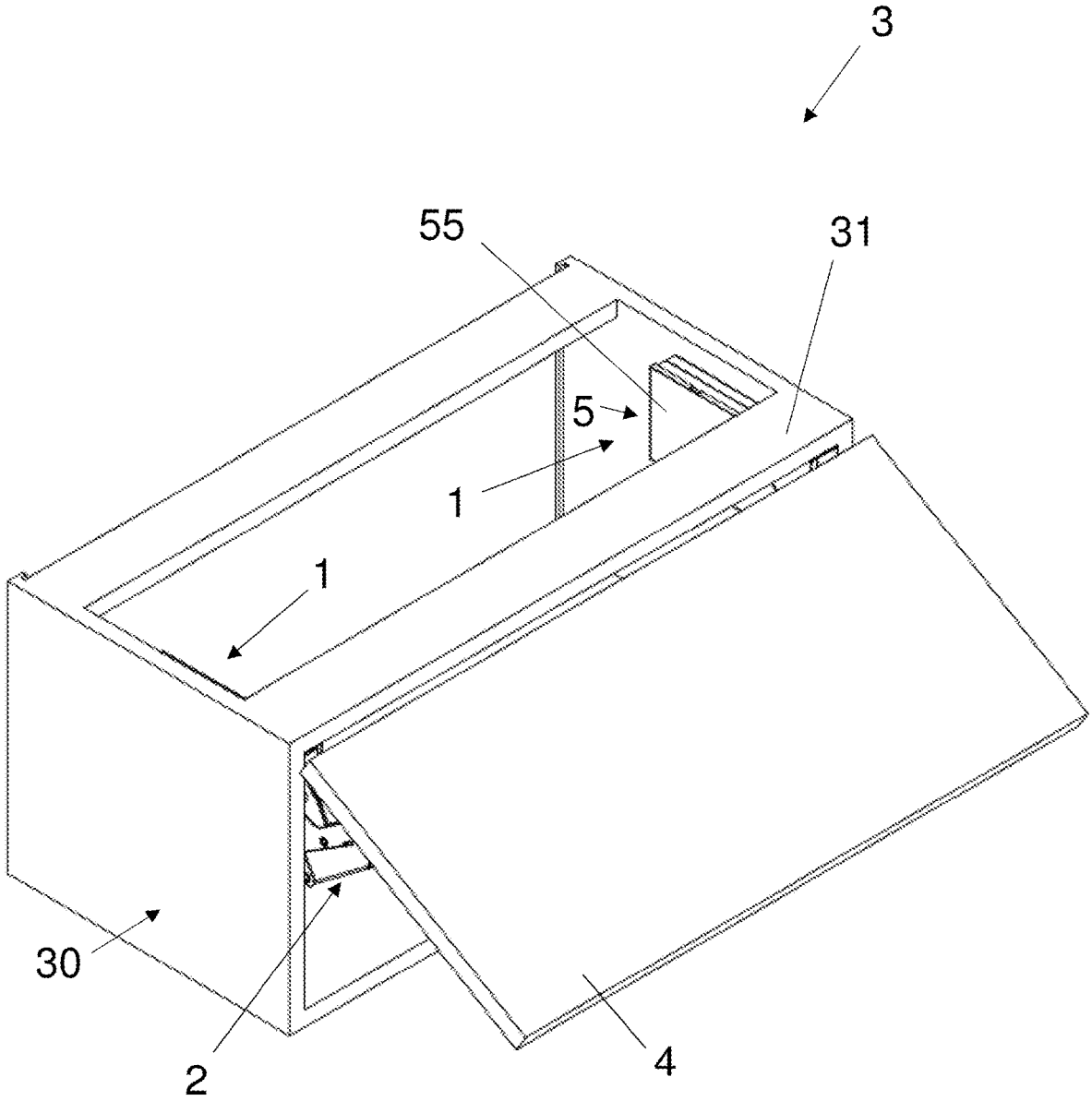
FIG. 1*a* a perspective view of a piece of furniture.

FIG. 1*a* shows a piece of furniture 3 with a furniture carcass 30, in the interior of which two actuating arm drives 1 are installed under a carcass top 31. A movable flap 4 is secured to the actuating arms 2 of the actuating arm drives 1 and is thus mounted pivotably on the furniture carcass 30 by the actuating arm drives 1. The actuating arm drive 1 is secured to the furniture carcass 30 via a housing 5 provided with a housing cover 55.

Figure 1B:
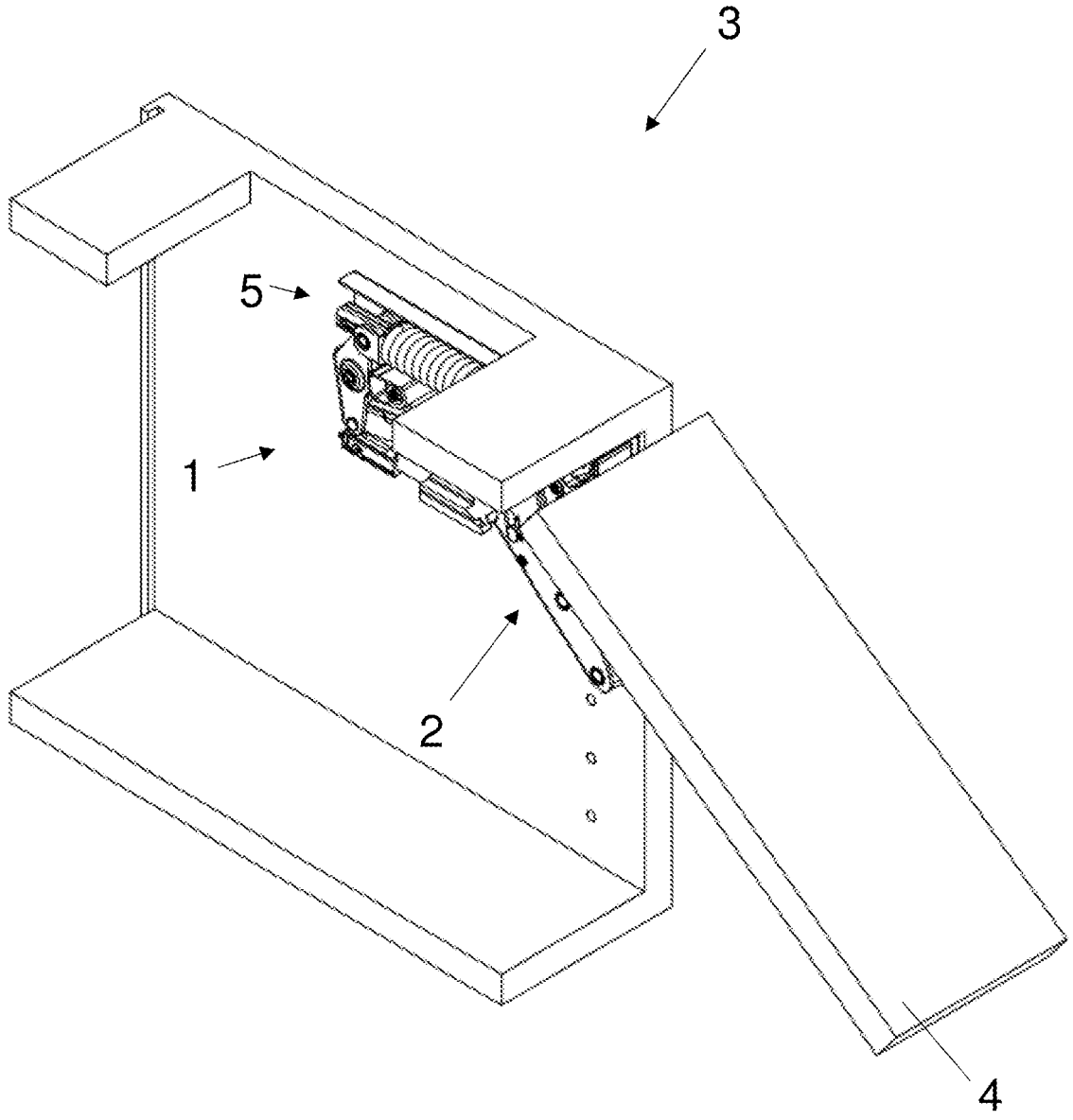
FIG. 1*b* a perspective sectional representation of a piece of furniture.

FIG. 1*b* shows a perspective view of a sectional representation of the piece of furniture 3 shown in FIG. 1*a*, wherein the actuating arm drive 1 is shown without the housing cover 55 of the housing 5. As above, a flap 4 is secured to the actuating arm 2 of the actuating arm drive 1.

Figure 2A:
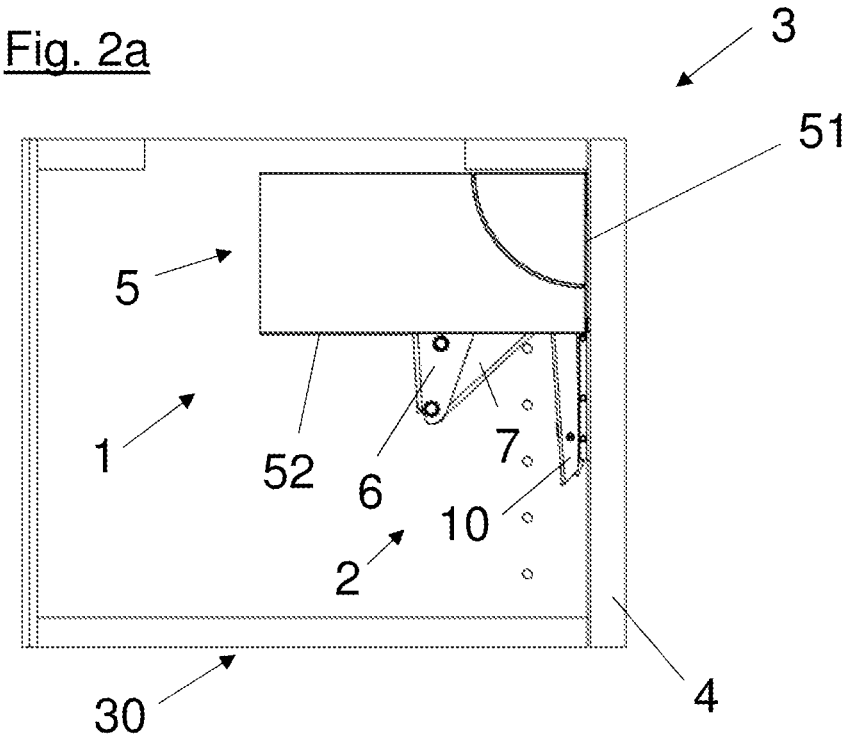
FIGS. 2*a* to 2*d* a side view of a sectional representation of a piece of furniture with different positions of the actuating arm drive, FIG. 3 a perspective view of an actuating arm drive, FIGS. 4*a* to 4*c* a side view of an actuating arm drive in different pivot positions, FIG. 5*a* a side view of a sectional representation of an actuating arm drive, FIG. 5*b* a detail view of the actuating arm drive shown in FIG. 5*a*, FIG. 6 a side view of two levers of an actuating arm drive, FIGS. 7*a* to 7*d* a side view of a sectional representation of a piece of furniture, FIGS. 8*a* and 8*b* a side view and a detail view of a piece of furniture with an actuating arm drive in a first setting, FIGS. 9*a* and 9*b* a side view and a detail view of a piece of furniture with an actuating arm drive in a second setting and FIGS. 10*a* and 10*b* a further side view and detail view of a piece of furniture with an actuating arm drive in different settings.

FIGS. 2*a* to 2*d* show the progression of an opening movement—or, with the sequence reversed, the progression of a closing movement—of a piece of furniture 3 with a pivotably mounted flap 4. Here, the closed position of the actuating arm drive 1, in which the furniture carcass 30 is closed by the flap 4, is shown in FIG. 2*a*. As shown in the embodiment of FIG. 2*a*, the actuating arm drive 1 has a pivotably mounted actuating arm 2 with several levers connected to each other in an articulated manner, wherein parts of the main lever 6 mounted pivotably on the housing 5, and parts of the intermediate lever 7 mounted pivotably thereon, and a part of the supporting lever 10 formed to secure the flap 4 are to be seen here. In the closed position of the actuating arm drive 1 shown, the main lever 6 and the intermediate lever 7, connected thereto in an articulated manner, as well as the supporting lever 10 protrude from a long side 52 of the housing 5. In the closed position of the embodiment shown the front side 51, facing the inner side of the flap 4, of the housing 5 of the actuating arm drive 1 is free of protruding levers of the actuating arm 2 and closes substantially flush with the furniture carcass 30.

Figure 2B:
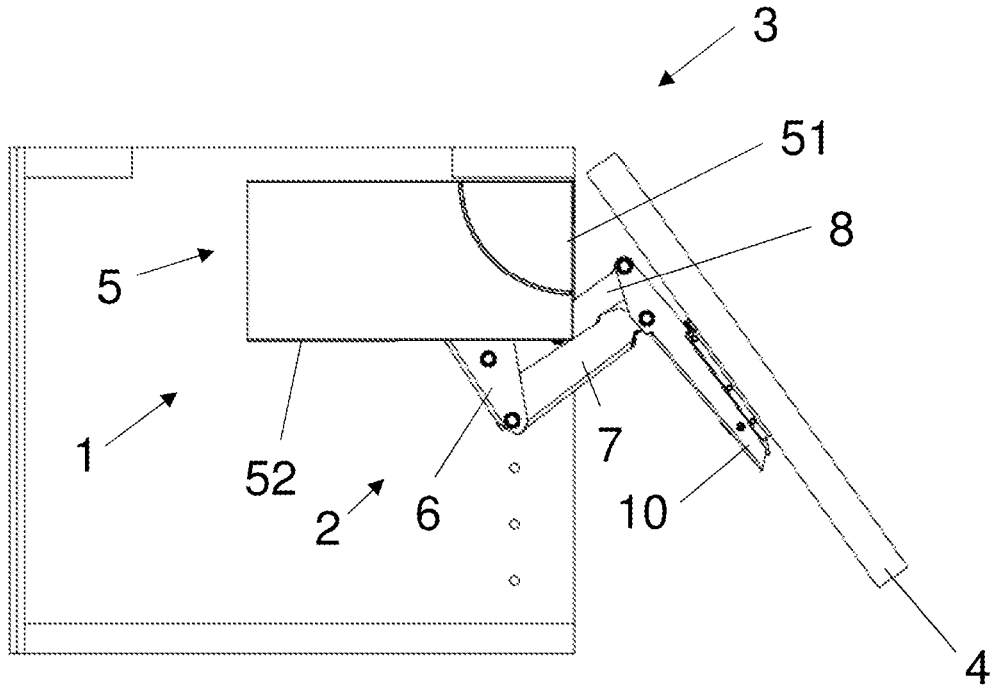

FIG. 2*b* shows a piece of furniture 3 with a partially opened flap 4. The actuating arm 2 of the actuating arm drive 1 supporting the flap 4 is partially pivoted out of the closed position. In this position of the actuating arm 2 pivoted in the direction of the open position, the levers of the actuating arm 2 connected to each other in an articulated manner protrude partially from the long side 52 of the housing 5 and partially from the front side 51 of the housing 5. In addition to the main lever 6, the intermediate levers 7, 8 arranged nested in each other as well as the supporting lever 10 mounted pivotably thereon are visible here.

Figure 2C:
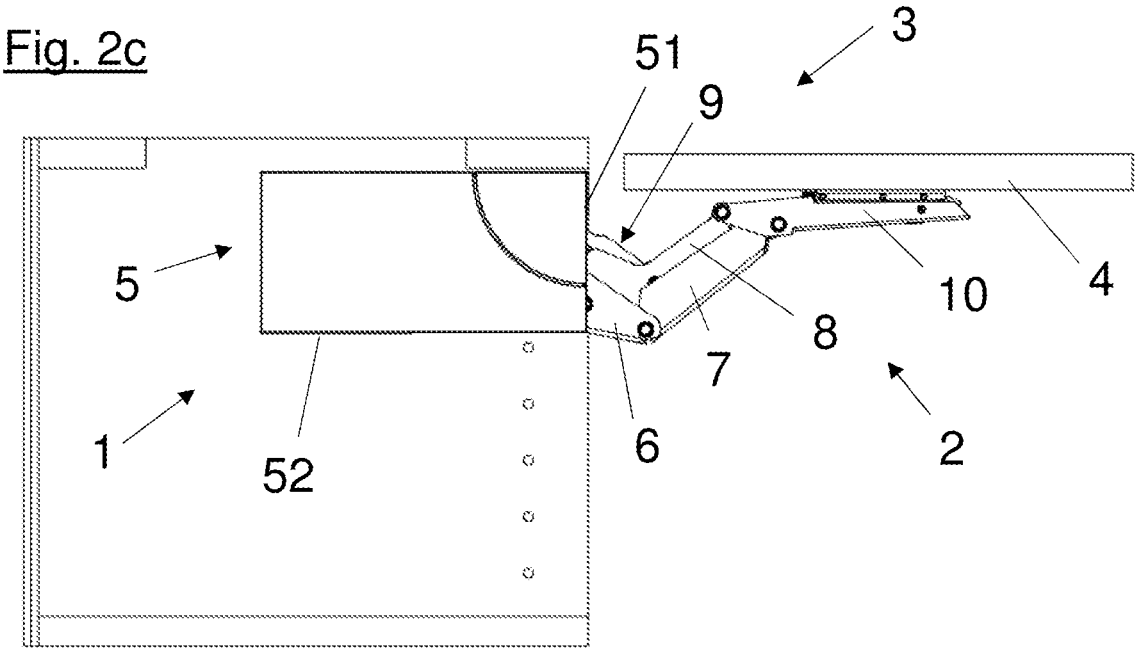

FIG. 2*c* shows a piece of furniture 3 with a furniture flap 4 pivoted further in the direction of the open position. Here, the actuating arm 2 supporting the flap 4 is pivoted further in the direction of the open position, with the result that now, in addition to the main lever 6 and the intermediate levers 7, 8 arranged nested in each other and the supporting lever 10, the guide lever 9 mounted pivotably on the housing 5 is also to be seen. As shown, a nested seven-joint linkage is formed by the levers. In this pivot position of the actuating arm 2, the long side 52 of the housing 5 is already free of protruding levers, whereby it can be made much easier for a user to access the interior of the piece of furniture 3. The levers forming the actuating arm 2 therefore protrude only from the front side 51 of the housing 5 in this pivot position of the actuating arm drive 1 close to the open position.

Figure 2D:
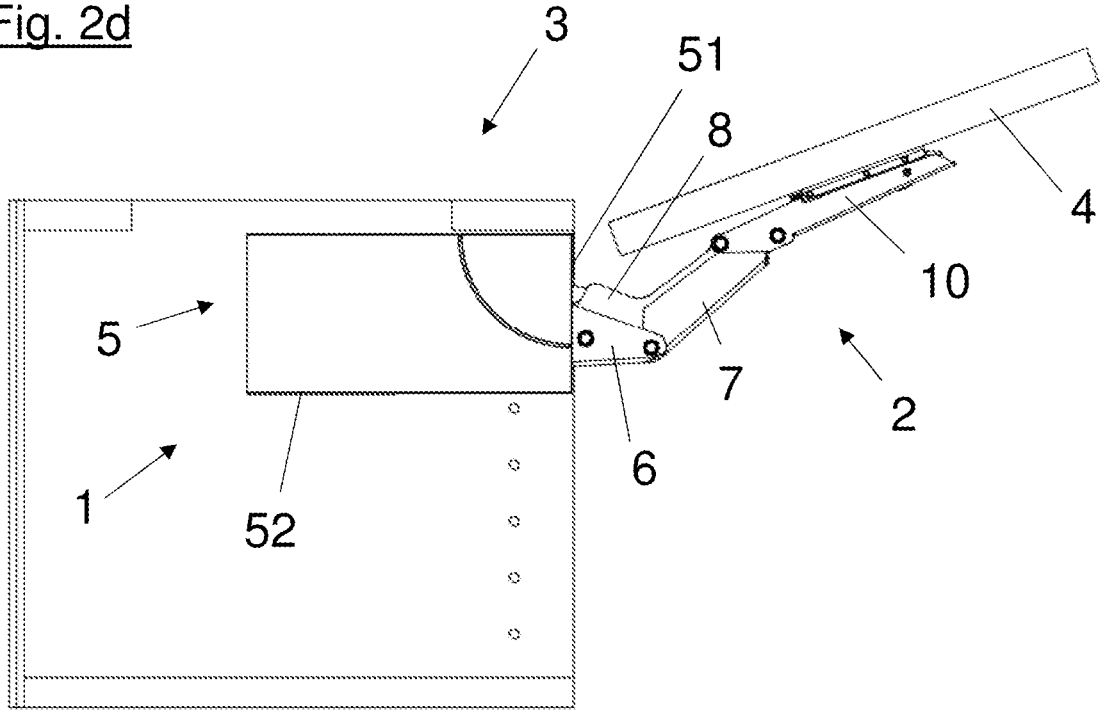

A piece of furniture 3 with a completely opened flap 4 is shown in FIG. 2*d*. The actuating arm 2 of the actuating arm drive 1 here is in the open position, in which the levers forming the actuating arm 2 protrude from the front side 51 of the housing 5. In contrast to the closed position of the actuating arm drive 1, in the open position of the actuating arm drive 1, the long side 52 of the housing 5 directly adjoining the front side 51 is free of protruding levers.

Figure 3:
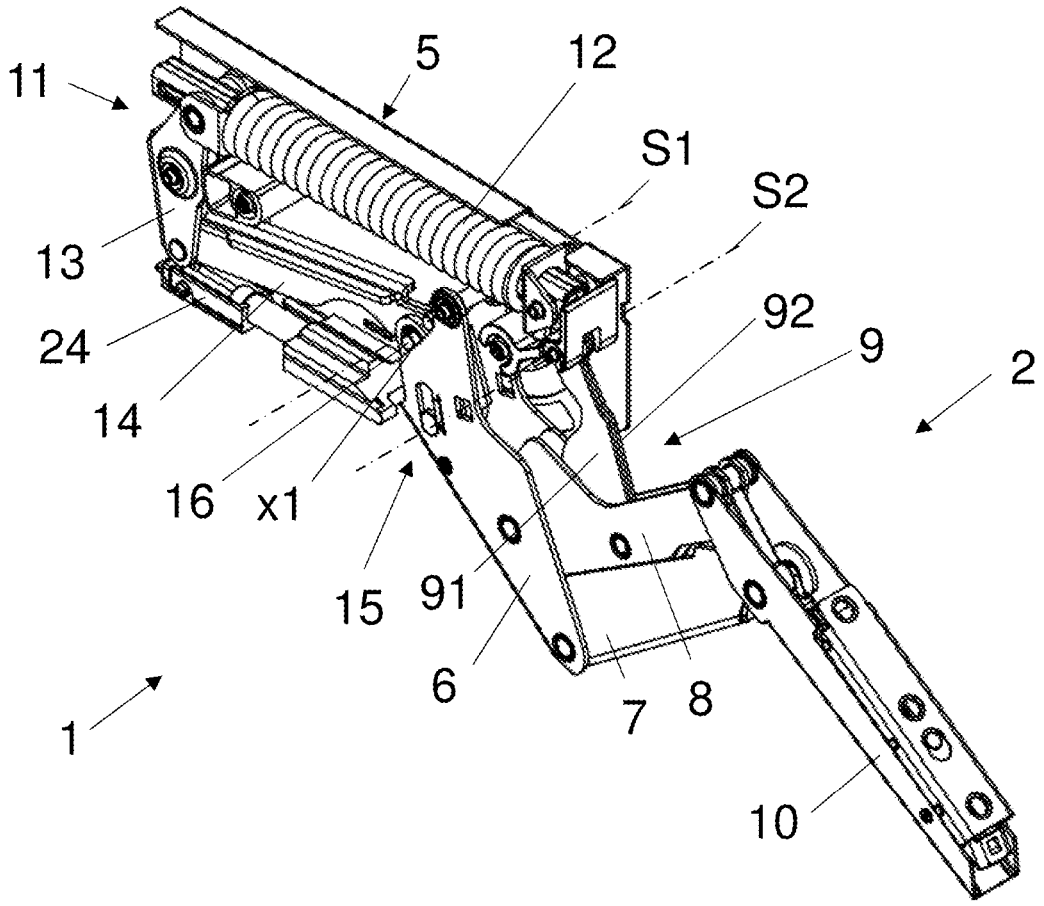

FIG. 3 shows a perspective view of an actuating arm drive 1 with housing cover removed. The alignment of the actuating arm drive 1 here substantially corresponds to the installed position in a piece of furniture 3 shown in the preceding figures. The housing 5 of the actuating arm drive 1 accommodates an energy storage mechanism 11 with a spring 12 installed lying down, running substantially horizontally, a bell crank 13 connected thereto in an articulated manner and mounted pivotably on the housing 5, and a transfer lever 14 connected pivotably to it. The actuating arm drive 1 also has a damping device 24 for damping the pivoting movement of the actuating arm 2 during a closing movement. In the embodiment of the actuating arm drive 1 shown in FIG. 3, the actuating arm 2 is formed of a main lever 6 mounted on the housing 5 pivotably about a first pivot axis S1, two intermediate levers 7, 8 mounted pivotably on the main lever 6, a guide lever 9 mounted pivotably on the second intermediate lever 8 and, about a second pivot axis S2, on the housing 5, and a supporting lever 10 mounted pivotably on the intermediate levers 7, 8. The guide lever 9 is formed of a first lever 91 and a second lever 92 connected thereto, as well as a third lever 93, not visible here. The main lever 6 and the first intermediate lever 7 have a profiled cross section, corresponding substantially to a U-shaped profile, and are arranged nested in each other. In addition, the first intermediate lever 7 and the second intermediate lever 8 are arranged nested in each other, as is also true of the second intermediate lever 8 and the guide lever 9. Overall a particularly stable design of the actuating arm 2 with a particularly small space requirement can be achieved by the nested arrangement of the main lever 6, the intermediate levers 7, 8 and the guide lever 9. The main lever 6 is loaded with a force by the energy storage mechanism 11 via a force-transmission element 16. Here, the force-transmission element 16 is connected pivotably to the transfer lever 14 of the energy storage mechanism 11 and pivotably to the setting device 15 attached to the main lever 6. The force-transmission point x1 of the force-transmission element 16 is positioned on the main lever below the pivot axis S1, whereby a torque is effectively exerted on the main lever 6 by the energy storage mechanism 11, with the result that the actuating arm 2 is pivoted in the direction of the open position without external influence.

Figure 4A:
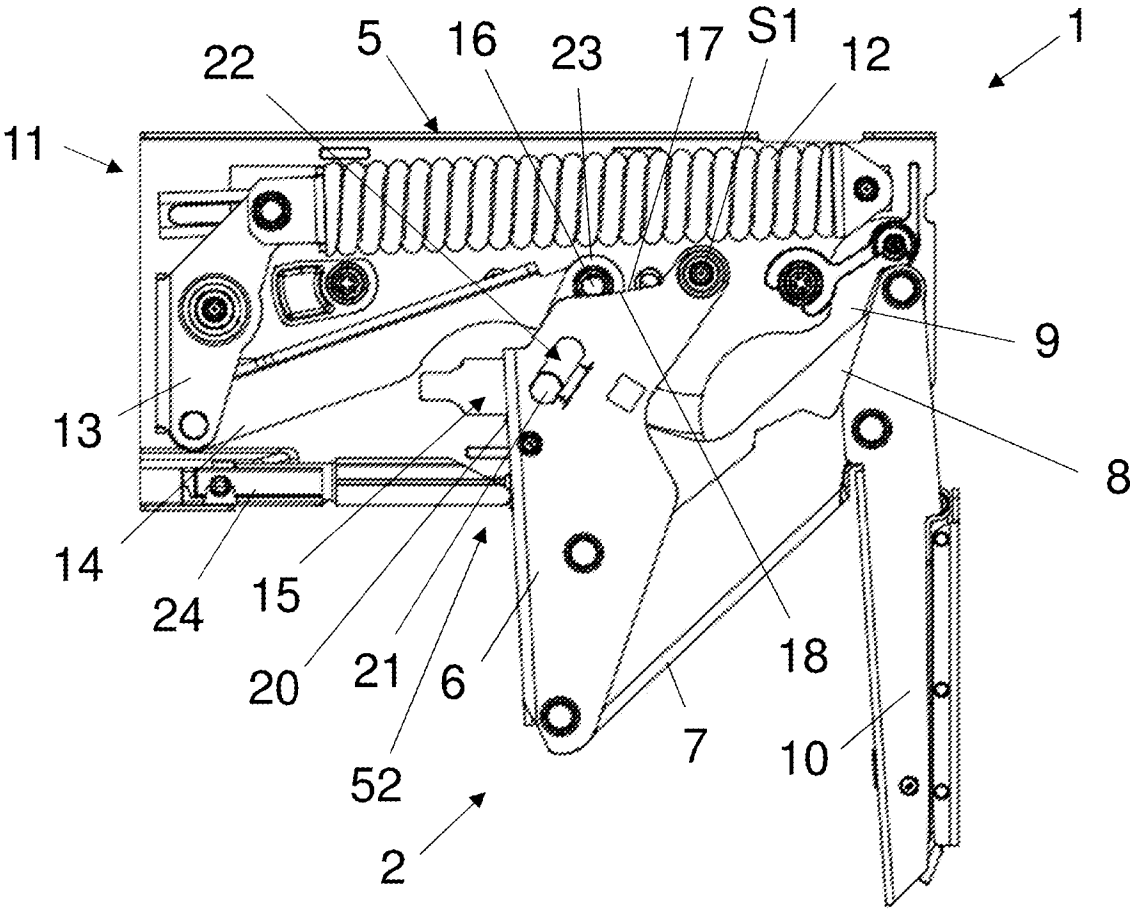

FIG. 4*a* shows a side view of an actuating arm drive 1 with housing cover removed. As shown, the actuating arm 2 of the actuating arm drive 1 is in the closed position, wherein the force originating from the energy storage mechanism 11 via the transfer lever 14 acts on the main lever 6 of the actuating arm 2 in such a way that it is actively pushed into the closed position. The line of action of the force originating from the energy storage mechanism 11 thus runs along the transfer lever 14 in relation to the pivot axis S1 of the main lever 6 (above the pivot axis S1) in such a way that the main lever 6 is actively pivoted into the closed position via the force-transmission element 16 connected to the main lever 6 by the setting device 15 and is held there. The setting device 15 is formed in the form of a threaded spindle 20 mounted rotatably on the main lever 6 (for this, see also FIG. 5*a*), a sliding block 21 mounted displaceably in the threaded spindle 20, a guideway 22 formed substantially in a straight line in the main lever 6, and a connecting piece 23 connected in an articulated manner to the sliding block 21 and the force-transmission element 16. The threaded spindle 20, the sliding block 21, and the connecting piece 23 here are at least partially arranged in the inner region of the main lever 6 formed profiled. For the bearing of the force-transmission element 16, a bearing contour 17 is formed on end faces 18 of the main lever 6, wherein the setting device 15 is formed to adjust the force-transmission element 16 along the bearing contour 17.

Figure 4B:
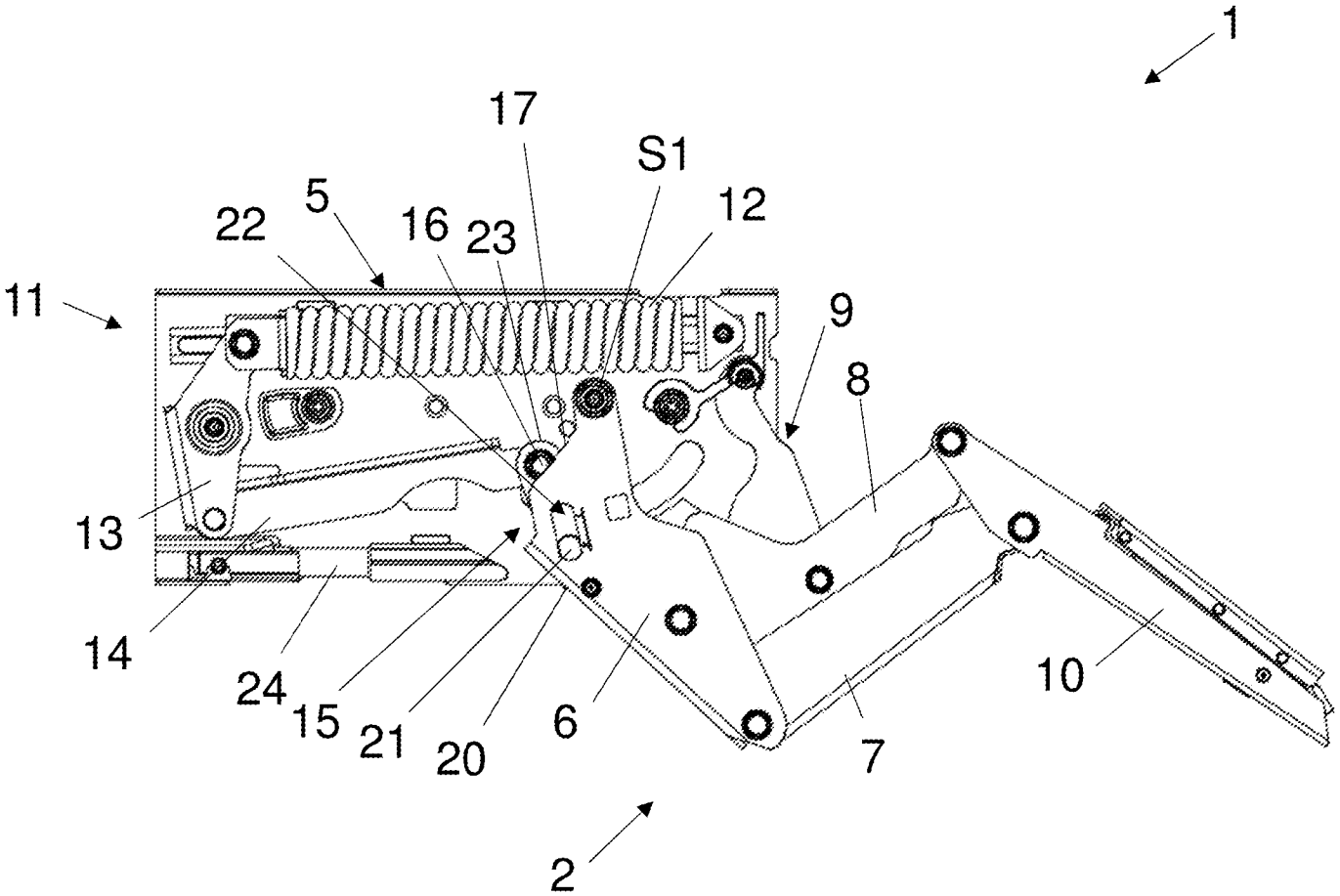
Figure 4C:
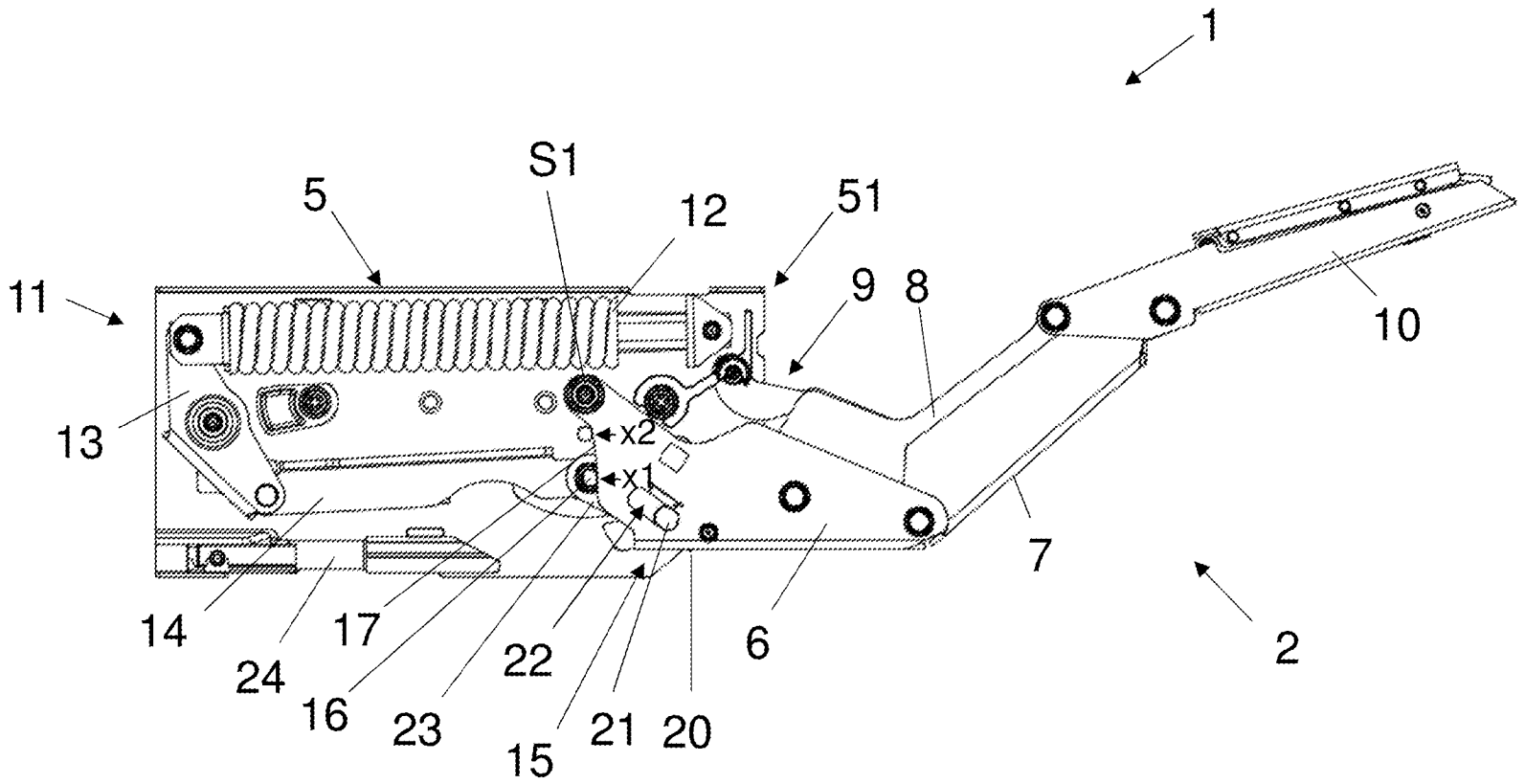
Figure 7A:
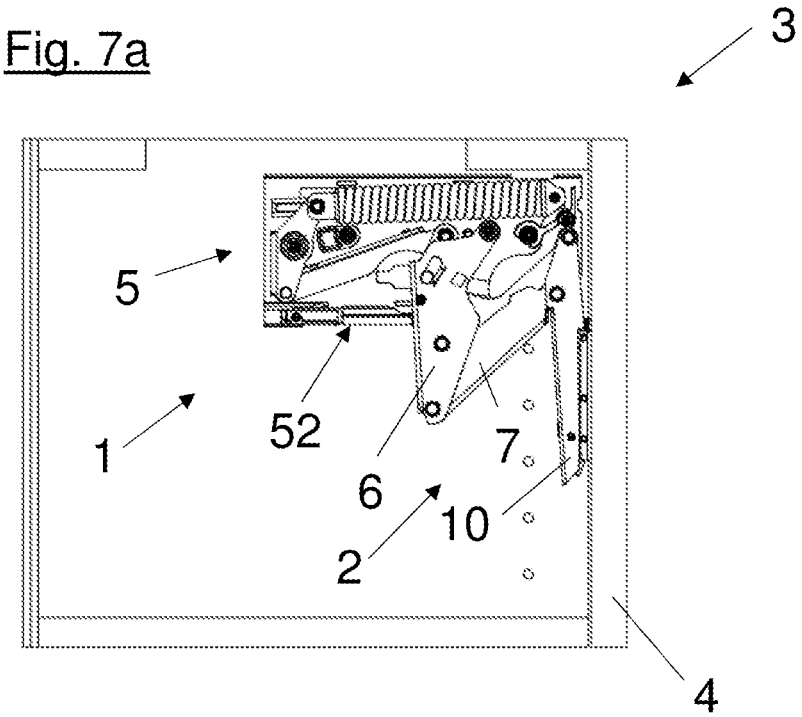
Figure 7B:
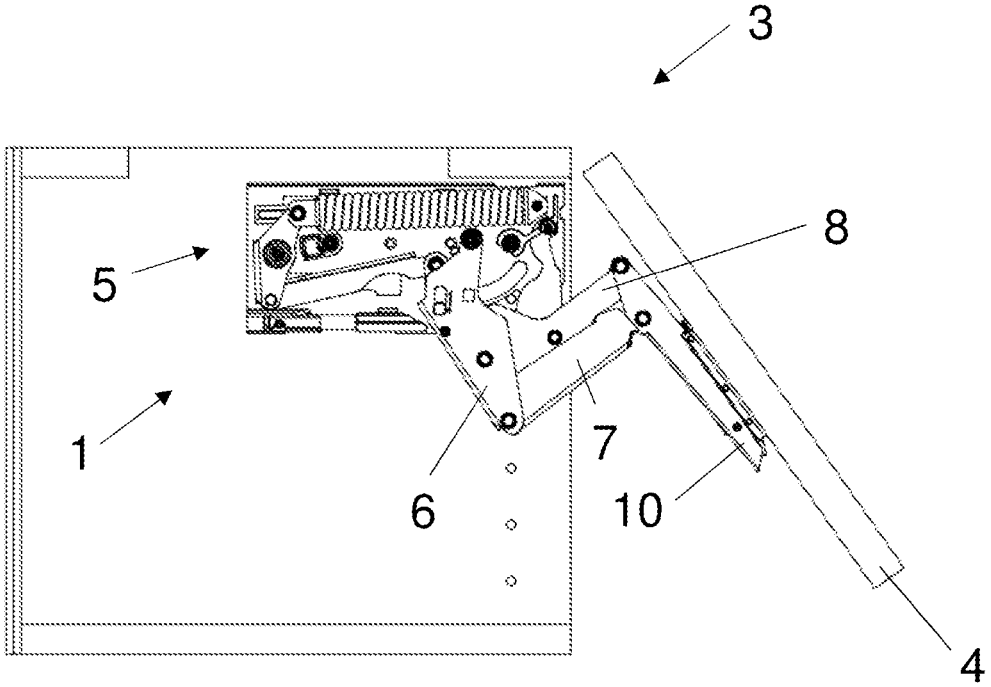
Figure 7C:
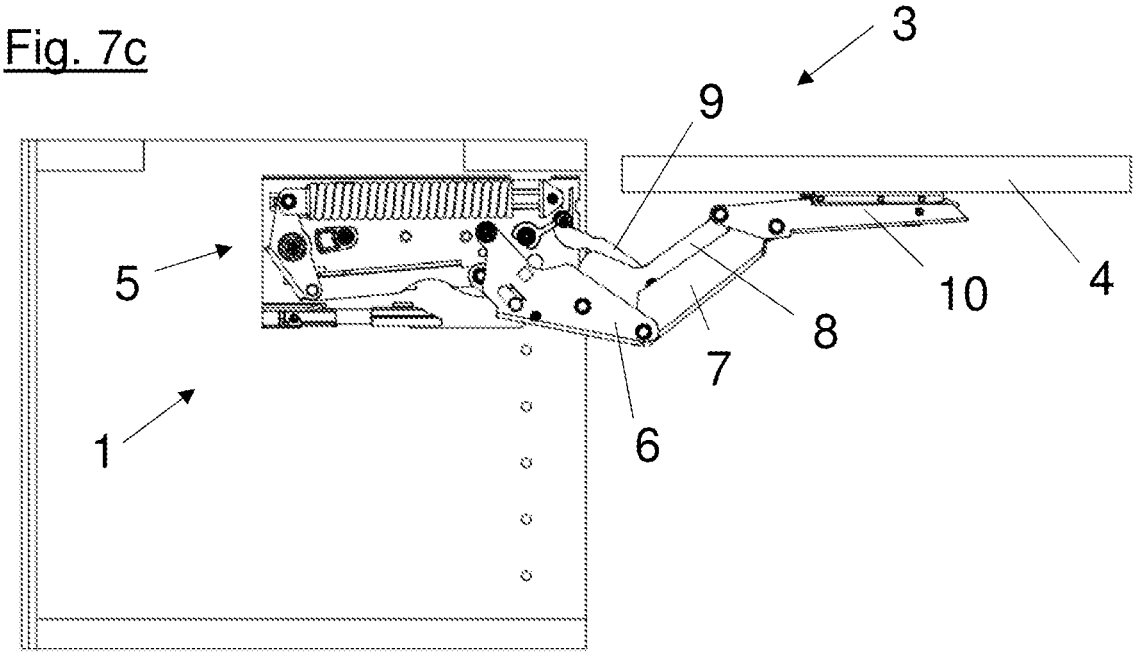
Figure 7D:
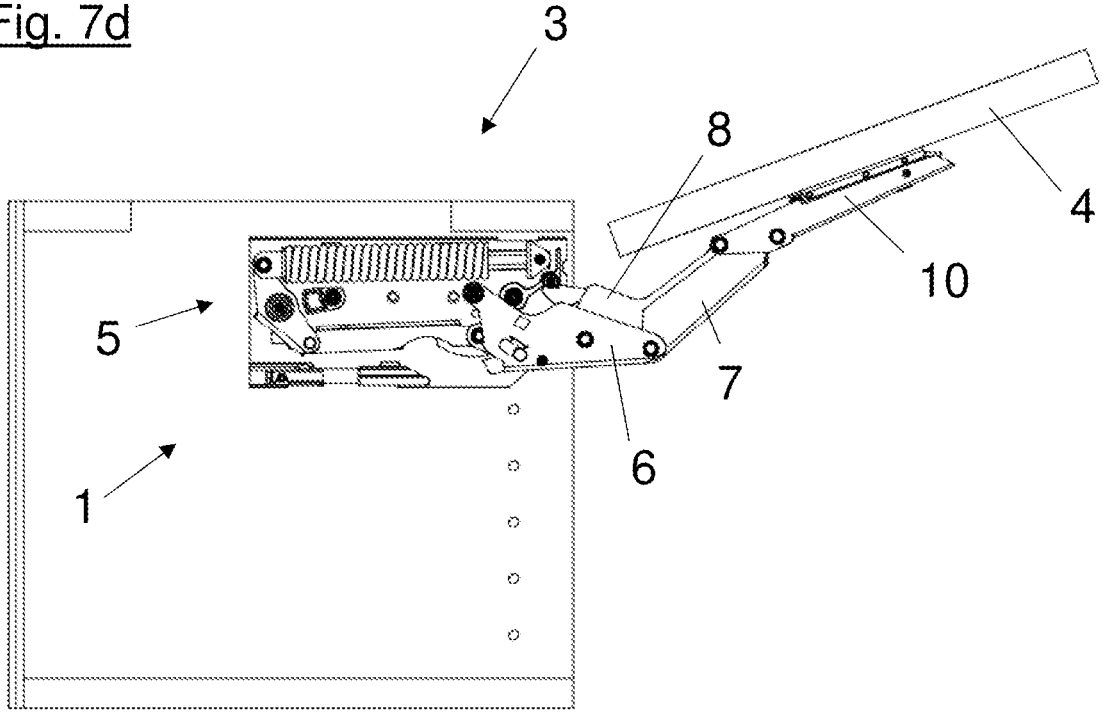

An actuating arm drive 1 with an actuating arm 2 partially pivoted out of the closed position is shown in FIG. 4*b*. Here, by comparison with FIG. 4*a*, the nested structure of the levers of the actuating arm 2 forming a seven-joint linkage is recognizable. In this pivot position of the actuating arm 2, the line of action of the force acting on the main lever 6 running along the transfer lever 14 of the energy storage mechanism 11 runs in relation to the pivot axis S1 of the main lever 6 (below the pivot axis S1) in such a way that the actuating arm 2 is pushed further in the direction of the open position. The substantially gap-free overlap between the two intermediate levers 7, 8 in a lateral direction relative to the pivoting movement of the actuating arm 2 is also clearly recognizable. An actuating arm drive 1 with an actuating arm 2 in the open position is shown in FIG. 4*c*. Here, the levers forming the actuating arm 2 protrude from the front side 51 of the housing 5 of the actuating arm drive 1. As shown, the setting device 15 is in a setting in which the force-transmission element 16 is positioned on the bearing contour 17 at a first force-transmission point x1. In this setting, the spacing (radially) between the pivot axis S1 of the main lever 6 and the first force-transmission point x1 is at its maximum size, whereby a large force acts on the actuating arm 2 from the energy storage mechanism 11. A further setting of the setting device 15, in which the stylistically indicated force-transmission element is positioned at the second force-transmission point x2, is positioned further in the direction of the pivot axis S1 (for this, see also FIG. 9*a*). In the open position of the actuating arm drive, an adjustment of the force-transmission point of the force-transmission element 16 on the bearing contour 17 of the main lever 6 is effected substantially transversely to the line of action of the force running along the transfer lever 14. In the case of the use, as shown in FIG. 7*d*, of the actuating arm drive 1 with a piece of furniture 3 with a flap 4 driven by the actuating arm drive 1, this has the advantage that one setting of the setting device 15 corresponds directly to the force acting on the flap 4 (compensation for the force on the actuating arm 2 exerted by the weight of the flap 4).

Figure 5A:
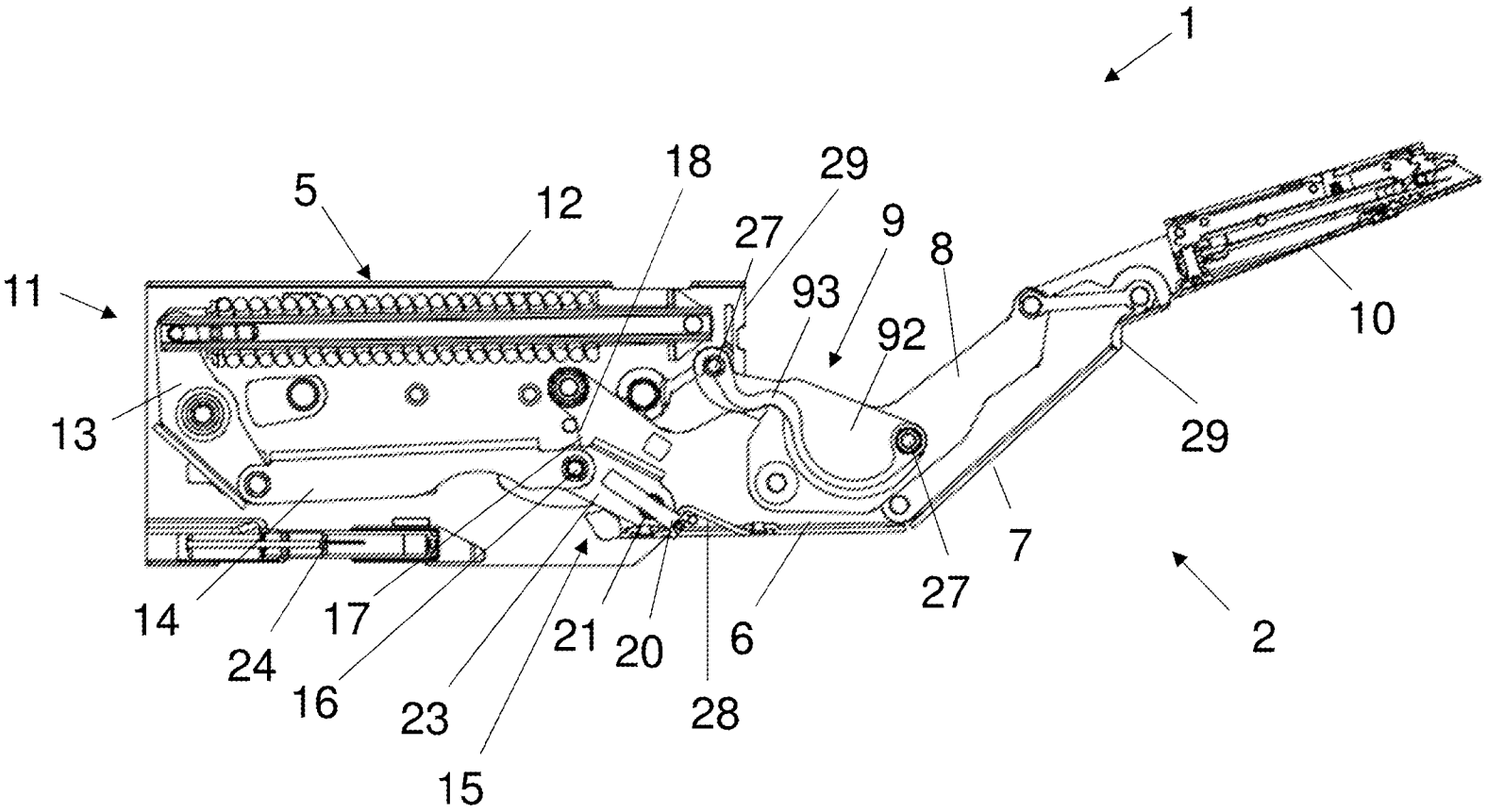

FIG. 5*a* shows a side view of a sectional representation of an actuating arm drive 1 in a pivot position of the actuating arm 2 as shown in FIG. 4*c*. Here, in addition to the energy storage mechanism 11 accommodated in the housing 5, the main lever 6 is shown with the positioning contour 17 formed on one of the end faces 18. The individual parts of the setting device 15 are likewise shown in this sectional representation. Specifically, these are the threaded spindle 20 mounted rotatably on a bearing point 28 formed in the main lever 6 and the sliding block 21 mounted therein, as well as the connecting piece 23 connected pivotably to the sliding block 21 and the force-transmission element 16. During a rotation of the threaded spindle 20, the non-rotatably mounted sliding block 21 can be displaced along the spindle in the guideway 22, not visible here, of the main lever 6. Here, the connecting piece 23, connected pivotably to the sliding block 21, as well as the force-transmission element 16, is also displaced and—loaded with force by the transfer lever 14 of the energy storage mechanism 11—the force-transmission element 16 thereby comes to rest at another point of the bearing contour 17.

In order to guarantee an effective screening and anti-trap protection in every pivot position of the actuating arm 2, cover plates 29 can be provided which automatically cover openings in the housing 5 or in the actuating arm 2 which form during pivoting.

The second lever 92 of the guide lever 9 as well as the third lever 93 introduced between the axle pins 27 of the guide lever 9 and serving for tolerance compensation are further shown in FIG. 5*a*. This is now to be discussed further in the following.

Figure 5B:
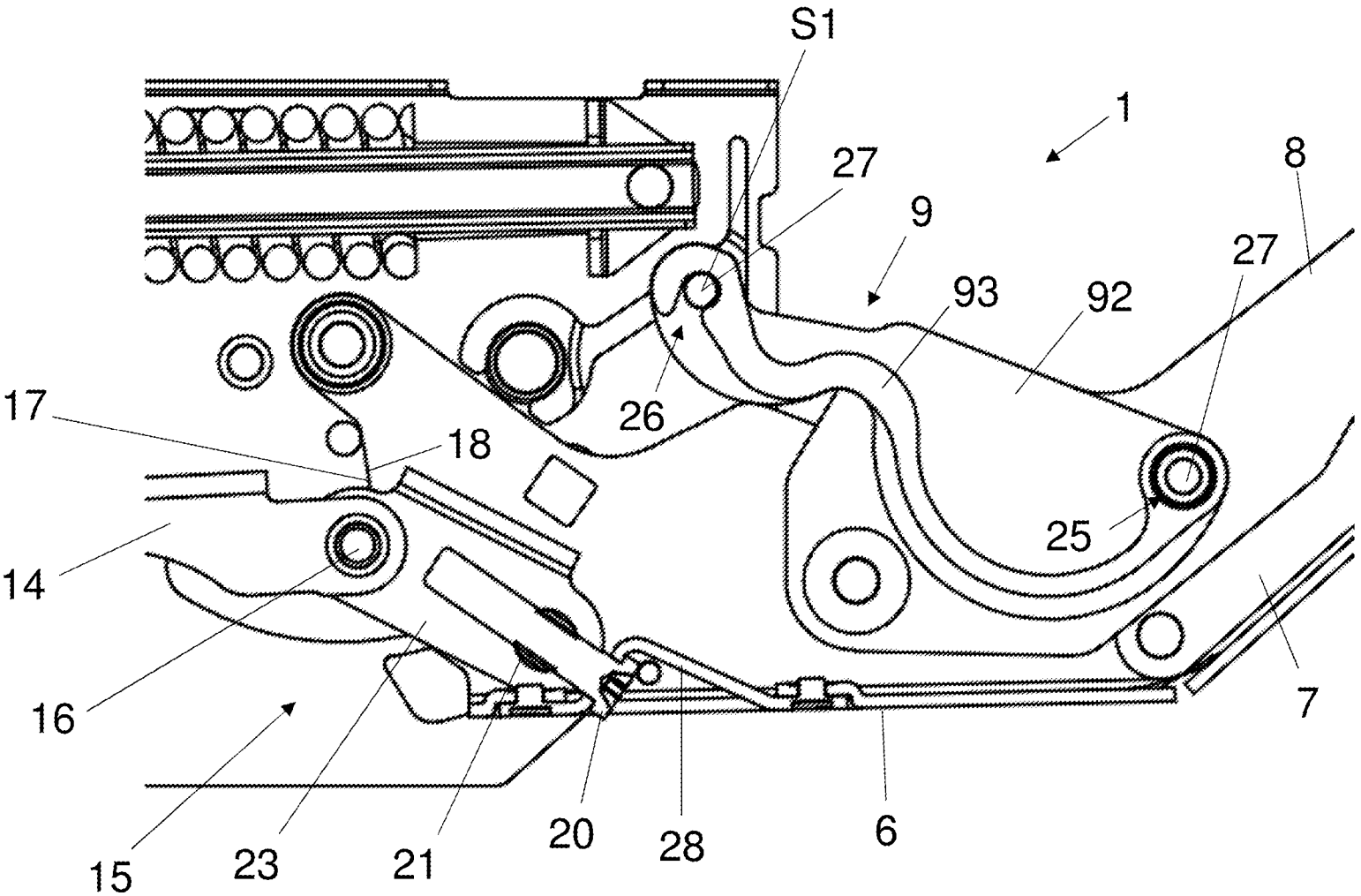

FIG. 5*b* shows a detail view of the sectional representation of the actuating arm drive 1 shown in FIG. 5*a*. In particular, the parts of the setting device 15 as well as two of the levers of the guide lever 9 are shown here. Thus, the second lever 92 of the guide lever 9 is shown with the housing-side axle pin 27 forming the pivot axis S1 and the further axle pin 27 serving for the pivotable mounting of the second intermediate lever 8. At one end, the third lever 93, having a wavy shape, has an axle hole 25, with which it is received on the further axle pin 27. At the other end, the third lever 93 has an indentation 26, by which the third lever 93 is pivoted or clipped onto the axle pin 27 forming the pivot axis S1. The axle pins 27 can be spread apart by the elastically resiliently deformed lever 93 in such a way that any radial play of the axle pins 27 existing because of manufacturing tolerances can be compensated for in the bearing points of the housing 5 or the levers.

Figure 6:
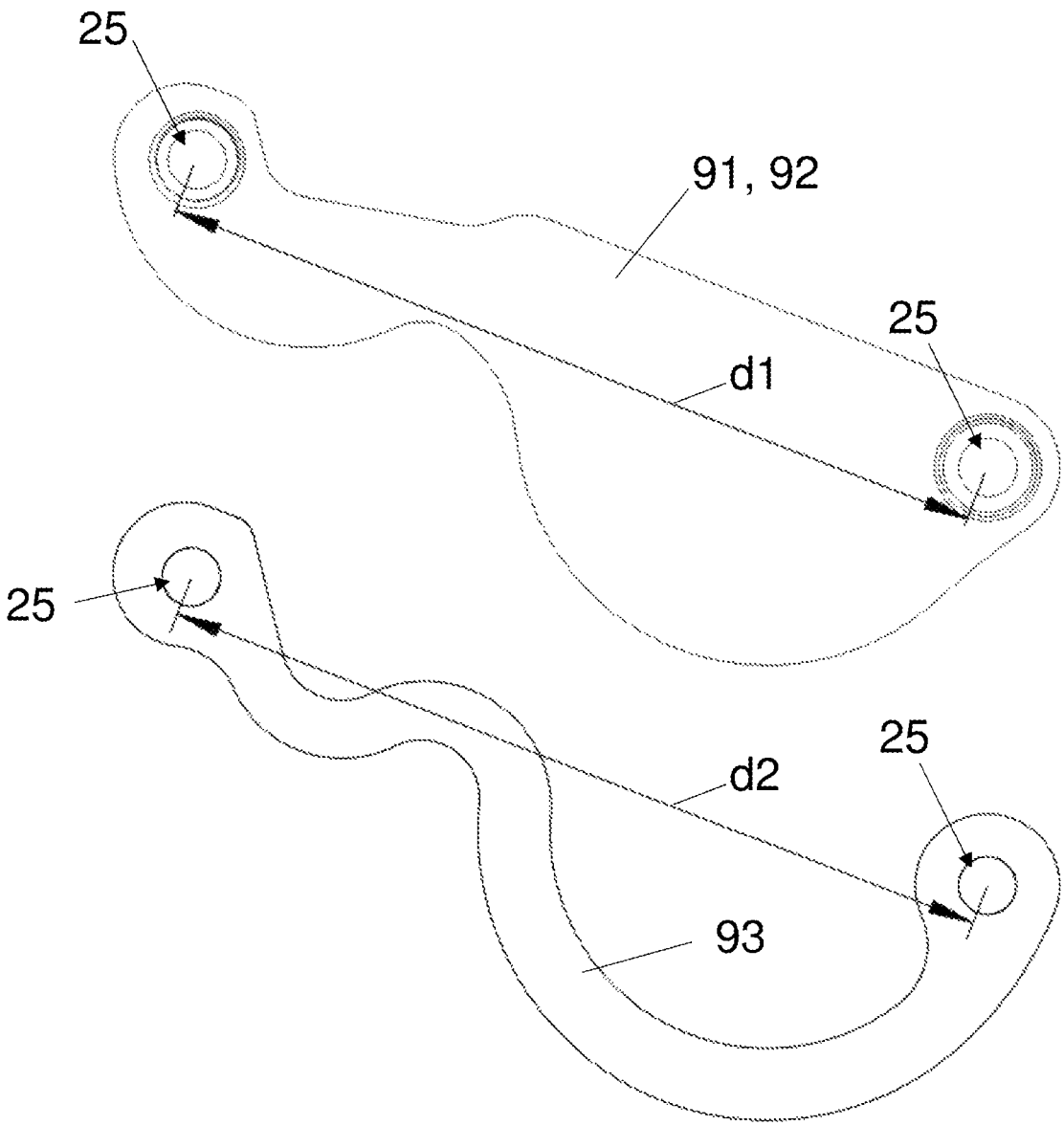

The first lever 91 and the third lever 93 are represented in FIG. 6. The representation of the first lever 91 here can also correspond to the representation of the second lever 92, if they are formed identically in terms of their shape. The first lever 91 here has two axle holes 25, the centers of which have a first standard spacing d1. In order to be able to guarantee a pivotable mounting of the first lever 91 (and also of the second lever 92), the axle holes 25 can have a slightly larger hole diameter than the axle pins 27 (not shown here) provided to be received therein. In this embodiment, the third lever 93 having a curved, wavy shape likewise has two axle holes 25. Their centers, however, have a second standard spacing d2 deviating from the first standard spacing d1. If the guide lever 9 is composed of the first lever 91, the second lever 92, and the third lever 93, preferably arranged between these, the third lever 93 can be pretensioned by stretching or compression to the first standard spacing d1, with the result that it retains its pretension in the installed state. A stabilization of the guide lever 9 composed of the individual levers can thereby result.

Analogously to FIGS. 2*a* to 2*d*, a process of opening or, with the sequence reversed, a process of closing a piece of furniture 3 with a flap 4 driven by an actuating arm drive 1 is shown in FIGS. 7*a* to 7*d*, wherein the actuating arm drive 1 is represented without the housing cover 55.

Figure 8A:
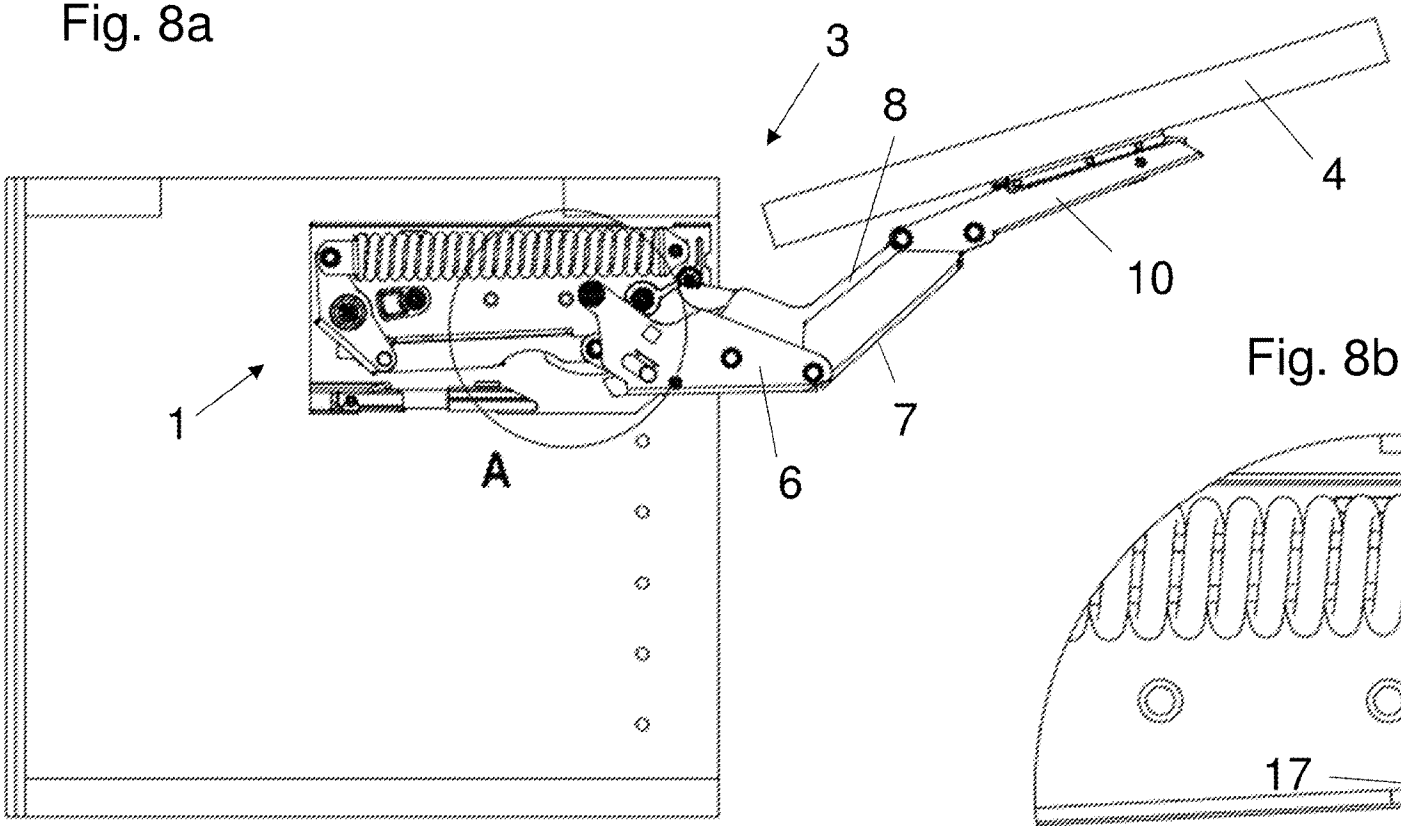
Figure 8B:
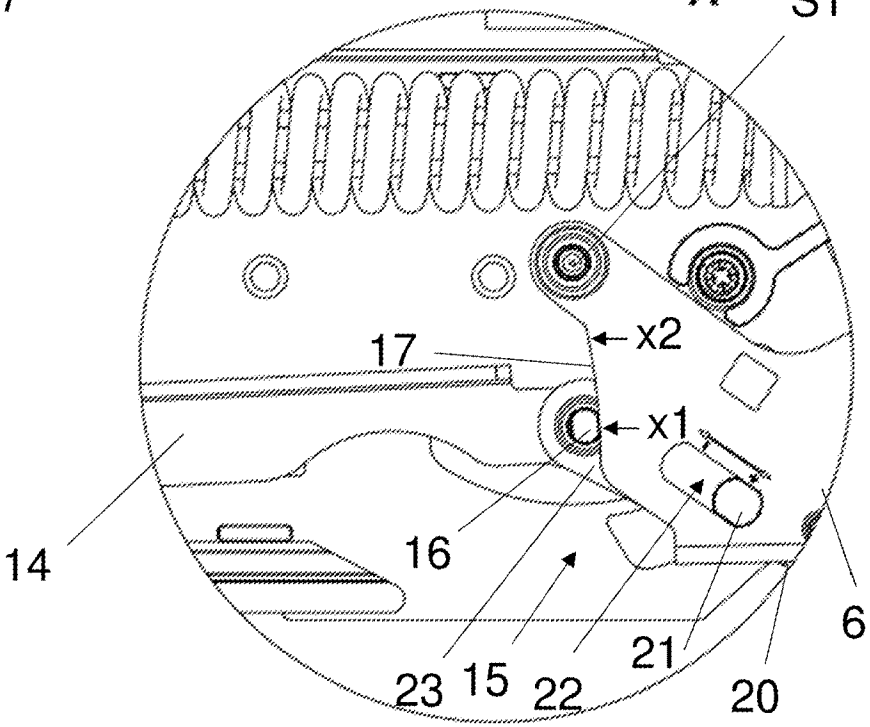

A side view and a detail view of a piece of furniture 3 with a substantially completely opened flap 4 is shown in FIG. 8*a* and FIG. 8*b*. As can be seen in the detail section A from FIG. 8*b*, the setting device 15 of the actuating arm drive 1 is in a first setting, in which the force-transmission element 16 transmitting the force from the energy storage mechanism 11 to the main lever 6 is located at a first force-transmission point x1 along the bearing contour 17 formed on the main lever 6. In this first setting of the setting device 15, as shown, the sliding block 21 displaceable by the threaded spindle in the guideway 22 is located at a first end of the guideway 22 remote from the bearing contour 17. Due to the connection existing via the connecting piece 23 between the sliding block 21 and the force-transmission element 16, the latter is positioned on the bearing contour 17 at a force-transmission point x1 remote from the pivot axis S1.

Figure 9A:
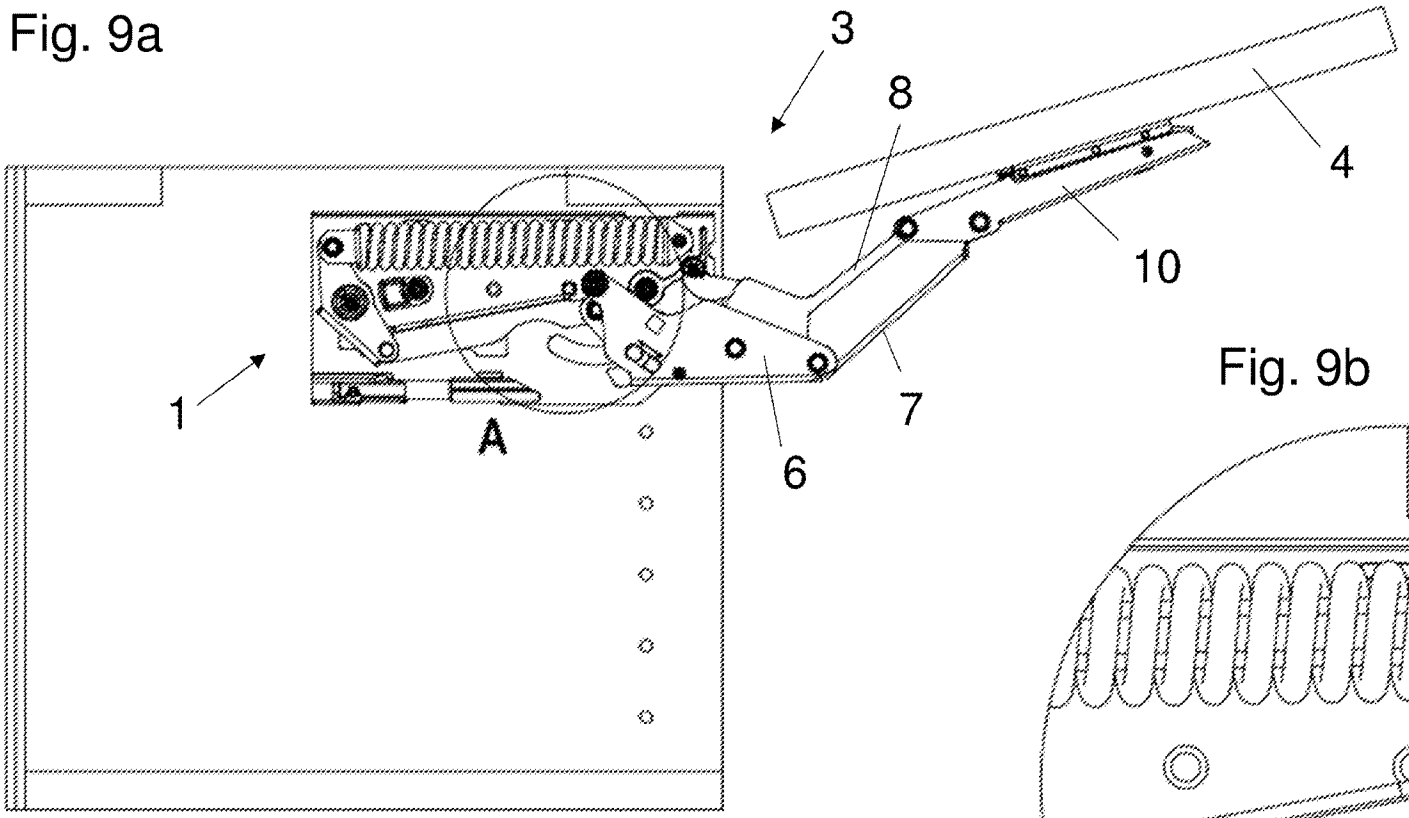
Figure 9B:
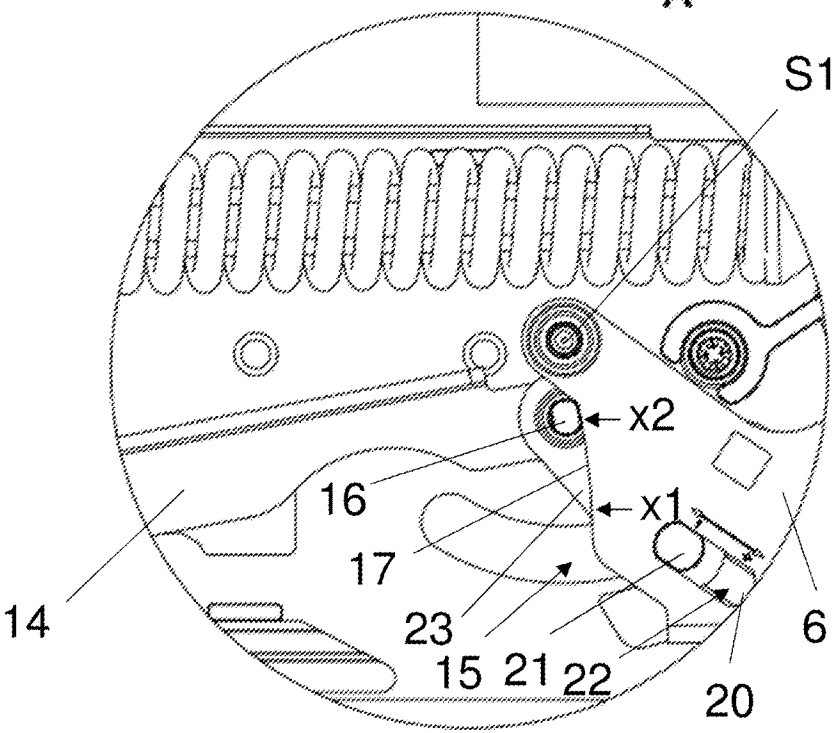

FIG. 9*a* and FIG. 9*b* show a side view and a detail view of a piece of furniture 3 with a substantially completely opened flap 4. As in the detail section A from FIG. 9*b*, the setting device 15 of the actuating arm drive 1 is in a second setting. In this second setting, the sliding block 21 mounted on the threaded spindle 20 is located at a second end of the guideway 22 facing the bearing contour 17. Due to the connection existing via the connecting piece 23 between the sliding block 21 and the force-transmission element 16, the latter is positioned along the bearing contour 17 at a second force-transmission point x2 closer to the pivot axis S1. In contrast to the first setting (see FIG. 8*a* and FIG. 8*b*), in this second setting of the setting device 15, the torque exerted on the main lever 6 is minimal, which is why this setting is suitable for compensating for the weight of flaps 4 with low unladen weight.

It is clearly recognizable in FIGS. 8*a*, 8*b*, 9*a* and 9*b* here that the bearing contour 17 has a concavely curved progression, which runs substantially transversely to and inclined towards the line of action of the force from the energy storage mechanism 11 running along the transfer lever 14. Through the curved formation of the bearing contour 17, it can be achieved, for one thing, that in the case of an adjustment of the setting device 15—and the associated adjustment of the force acting on the main lever 6 from the energy storage mechanism 11—the spring-loaded pre-tensioning of the spring 12 of the energy storage mechanism 11 remains substantially unchanged by a pivoting of the transfer lever 14 associated with adjustment of the setting device 15. It can also be achieved thereby that the force-transmission element 16 is always pushed along the bearing contour 17 in the same direction in every pivot position of the actuating arm drive 1 between the closed position and the open position, whereby undesired load reversals can be avoided during operation of the actuating arm drive 1. In the embodiments of the actuating arm drive shown in the preceding figures, this means specifically that the force-transmission element 16 is pushed along the bearing contour 17 substantially always in the direction of the pivot axis S1 in every pivot position of the actuating arm drive 1 between the open position and the closed position, whereby the setting device is always loaded by tension. In other words, at least a component of the force exerted by the energy storage mechanism 11 and transmitted by the force transmission element 16 is applied in the same direction along the bearing contour 17 of the main lever 6 regardless of the pivot position of the actuating arm drive and regardless of the setting of the setting device 15. If the direction in which the force-transmission element 16 is pushed (i.e., the direction in which the force is applied) along the bearing contour 17 is reversed, a change in direction of the loading (load reversal) specifically of the setting device 15 would occur, resulting in an undesired instability of the actuating arm drive 1 as well as potentially a noise generation by the actuating arm drive 1 constituted by a backlash.

Figure 10B:
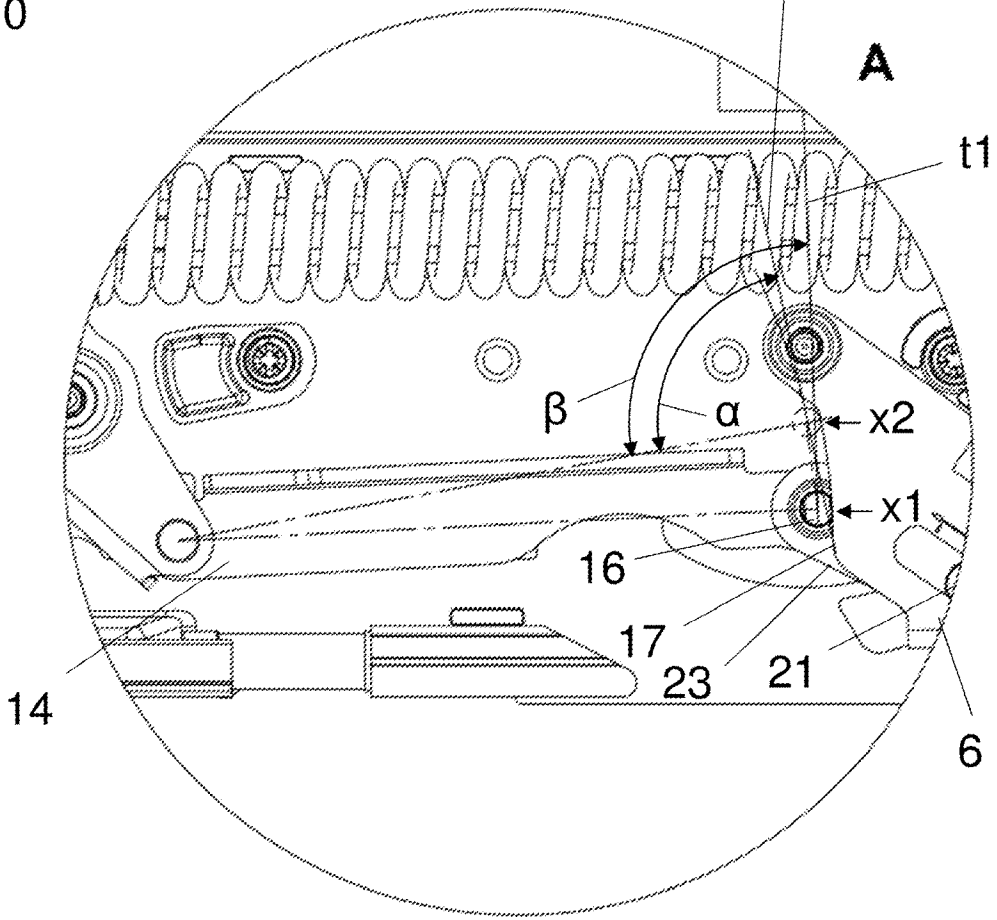
Figure 10A:
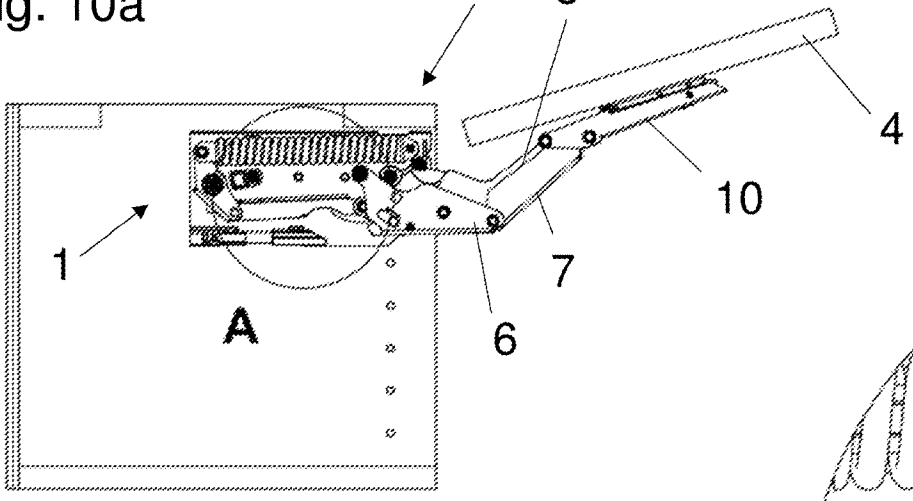

FIG. 10*a* and FIG. 10*b* show a side view and a detail view of a piece of furniture 3 with a flap 4 in the open position, wherein the lines of action of the force acting on the main lever 6 from the energy storage mechanism 11 running along the transfer lever 14 are shown in the detail section A from FIG. 10*b*. In a first setting of the setting device 15, the force-transmission element 16 is located at a first force-transmission point x1 along the bearing contour 17. The tangent t1 illustrates the inclination of the bearing contour 17 at the first force-transmission point x1. If the bearing contour 17 is formed in a straight line, the force-transmission element 16 would be displaced along the tangent t1 during an adjustment of the setting device 15. At a second force-transmission point x2, an obtuse angle β (larger than 90°) would thus result between the line of action running towards the second force-transmission point x2 and the tangent on the bearing contour. If, on the other hand, the bearing contour 17 is formed curved, specifically bulging concavely towards the line of action of the force, the angle α formed by the line of action of the force in the force-transmission point x2 and the inclination of the bearing contour 17 illustrated by the tangent t2 is an acute angle (smaller than 90°).

The invention claimed is:

1. An actuating arm drive for moving a pivotably mounted actuating arm, the actuating arm drive comprising:

a pivotably mounted main lever, an energy storage mechanism for exerting a force for supporting the opening and/or closing movement of the actuating arm drive on the main lever at a force-transmission point, a setting device for setting the force-transmission point on the main lever, and a force-transmission element to be loaded by the energy storage mechanism and configured to transmit the force to the main lever at the force-transmission point;

wherein the setting device is configured to adjust the force-transmission element along a bearing contour formed on the main lever, and wherein the main lever, the setting device, and the force-transmission element are configured such that at least a component of the force transmitted by the loaded force-transmission element to the main lever is applied in the same direction along the bearing contour of the main lever in every pivot position of the main lever between the open position and the closed position of the actuating arm drive and in every setting of the setting device.

2. The actuating arm drive according to claim 1, wherein the bearing contour is curved.

3. The actuating arm drive according to claim 2, wherein the curvature of the bearing contour is constant.

4. The actuating arm drive according to claim 2, wherein the bearing contour is concavely curved.

5. The actuating arm drive according to claim 2, wherein the force-transmission element has a contour deviating from a cylindrical surface.

6. The actuating arm drive according to claim 5, wherein the contour of the force-transmission element has a curvature corresponding to a curvature of the bearing contour.

7. The actuating arm drive according to claim 1, wherein, in a pivot position of the main lever corresponding to the open position of the actuating arm drive in every setting of the setting device, a line of action of the force from the energy storage mechanism acting on the main lever forms an acute angle with the bearing contour.

8. The actuating arm drive according to claim 1, wherein the bearing contour is formed at end faces of a profiled cross section of the main lever.

9. The actuating arm drive according to claim 1, wherein the force-transmission element is formed as at least one of a profiled transverse pin, a roller, and a slide.

10. The actuating arm drive according to claim 1, wherein the setting device is self-locking.

11. The actuating arm drive according to claim 1, wherein the setting device has a transfer device configured to convert a setting movement of the setting device into a translational movement of the force-transmission element.

12. The actuating arm drive according to claim 11, wherein the transfer device comprises a threaded spindle rotatably mounted on the main lever with a sliding block engaging in the threaded spindle, the sliding block being connected to the force-transmission element.

13. The actuating arm drive according to claim 12, wherein the sliding block is mounted displaceably in a guideway formed in the main lever and is connected in an articulated manner to the force-transmission element via a connecting piece.

14. The actuating arm drive according to claim 12, wherein the sliding block is mounted displaceably in the guideway so as to move in a substantially straight line.

15. The actuating arm drive according to claim 1, wherein, in a pivot position of the main lever corresponding to the open position of the actuating arm drive, the force-transmission element is adjusted along the bearing contour substantially transversely to the line of action of the force from the energy storage mechanism acting on the main lever.

16. The actuating arm drive according to claim 1, wherein, in a pivot position of the main lever corresponding to the closed position of the actuating arm drive, the line of action of the force from the energy storage mechanism acting on the main lever is in a direction relative to the pivot axis of the main lever such that the main lever is pushed into the closed position.

17. The actuating arm drive according to claim 1, wherein the energy storage mechanism includes a spring.

18. A piece of furniture comprising a furniture carcass, the actuating arm drive according to claim 1, and at least one flap.

19. The actuating arm drive according to claim 17, wherein the spring is arranged lying down in the installed position of the housing.

20. The actuating arm drive according to claim 1, further comprising a lever for loading the force-transmission element by the energy storage mechanism.

* * * * *